US005477631A

United States Patent [19]

Hewitt

[11] Patent Number: 5,477,631

[45] Date of Patent: Dec. 26, 1995

[54] EXPANDABLE DISPLAY DEVICE AND SPORTS CARD HOLDER

[76] Inventor: Harold O. Hewitt, 1909 21 Ave. SW, Calgary, Canada, T2T 0N6

[21] Appl. No.: 59,976

[22] Filed: May 13, 1993

[51] Int. Cl.[6] ..... G09F 7/00

[52] U.S. Cl. ..... 40/605; 40/124; 40/661; 40/600; 206/39

[58] Field of Search ..... 40/124, 124.2, 40/124.4, 155, 159, 661, 537, 605, 624, 600, 621; 206/0.82, 0.83, 0.84, 38, 39, 449, 456

[56] References Cited

U.S. PATENT DOCUMENTS

| | | | |
|---|---|---|---|
| 1,818,722 | 8/1931 | Lewis | 40/624 |
| 2,957,261 | 10/1960 | Moskowitz . | |
| 2,993,289 | 7/1961 | Miller, Jr. et al. | 40/624 |
| 3,168,787 | 10/1962 | Surrey . | |
| 3,263,357 | 8/1966 | Carleton | 40/152 X |
| 3,456,373 | 7/1969 | Epton . | |
| 3,466,126 | 9/1969 | Sakamoto . | |
| 3,753,306 | 8/1973 | Hemgren | 40/605 |
| 3,786,584 | 1/1974 | Holson . | |
| 3,826,026 | 7/1974 | Bevan . | |
| 3,852,901 | 12/1974 | Woodle et al. | 40/605 |
| 4,251,936 | 2/1981 | Ferrell . | |
| 4,594,802 | 6/1986 | Field . | |
| 4,741,534 | 5/1988 | Rogahn . | |
| 4,829,691 | 5/1989 | Manjos et al. . | |
| 4,912,864 | 4/1990 | Price . | |
| 4,918,848 | 4/1990 | Stein . | |
| 5,010,673 | 4/1991 | Connor et al. . | |
| 5,040,671 | 8/1991 | Hager . | |
| 5,046,616 | 9/1991 | Makowski et al. | 206/564 X |
| 5,050,834 | 9/1991 | Tardiff . | |
| 5,056,251 | 10/1991 | Connor et al. . | |
| 5,082,122 | 1/1992 | Connor, Jr. et al. . | |
| 5,097,953 | 3/1992 | Gingras . | |
| 5,121,563 | 6/1992 | Connor et al. . | |
| 5,133,450 | 7/1992 | Rademacher . | |
| 5,186,566 | 2/1993 | Cameron | 40/661 X |
| 5,269,083 | 12/1993 | Vampatella et al. | 40/621 X |

FOREIGN PATENT DOCUMENTS

| | | | |
|---|---|---|---|
| 9205534 | 4/1992 | WIPO | 40/600 |

*Primary Examiner*—Brian K. Green
*Attorney, Agent, or Firm*—Cushman, Darby & Cushman

[57] ABSTRACT

An expandable display device comprising a primary backing panel, which includes top, bottom, first, and second edge portions, a frame assembly including at least one top, bottom, primary and secondary side frame members selectively engaging the edge portions of the primary backing panel, and an assembly for selectively securing at least one card holder to the backing panel and/or the frame. The card holders suited to be secured thereto include two transparent panels. A channel is provided on an interior surface portion of one of the panels and positioned a distance from the edge thereof. The other panel has a ridge on said interior surface portion cooperating with the channel to maintain the two panels in a surface-to-surface abutting relation so that the card-like object is held between the two panels. A pair of exterior slots are provided in both panels and aligned such that the slots provide a gripping portion enabling a card holder to be easily removed from a flat surface by inserting a portion of a finger into the slot. The card holder also includes a separation assembly enabling the two panels to be easily separated. The card holder also includes an attachment assembly for securing the holder to the backing panel and/or the frame.

21 Claims, 9 Drawing Sheets

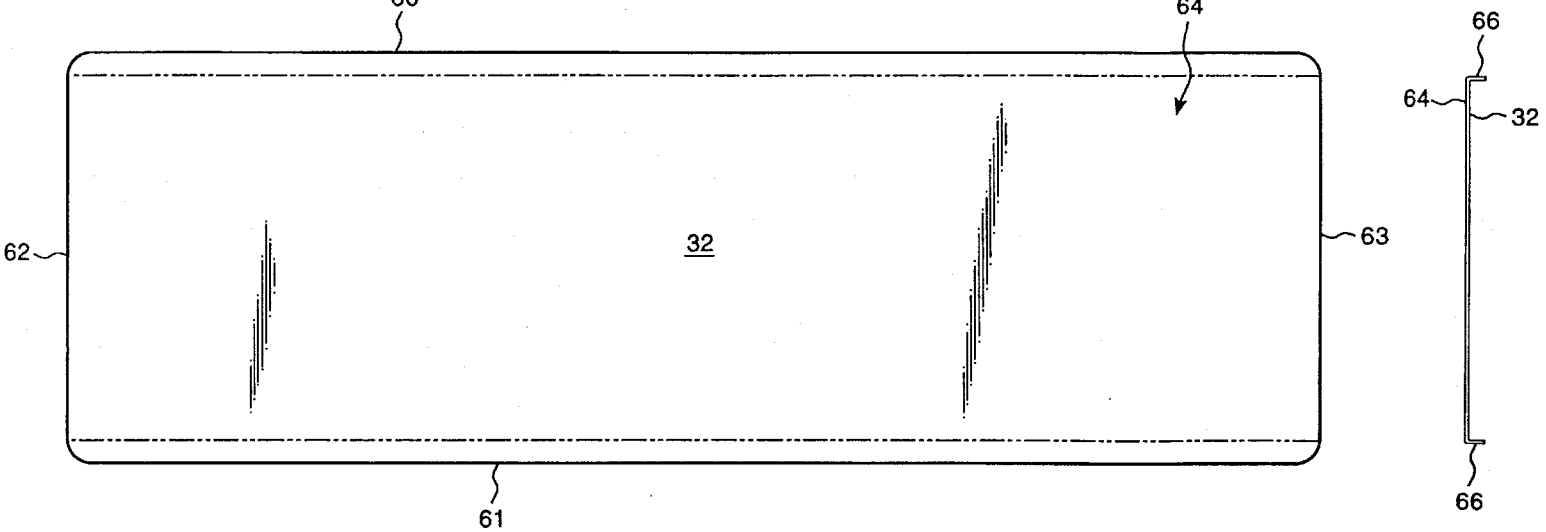
Fig. 2a'
Fig. 2a
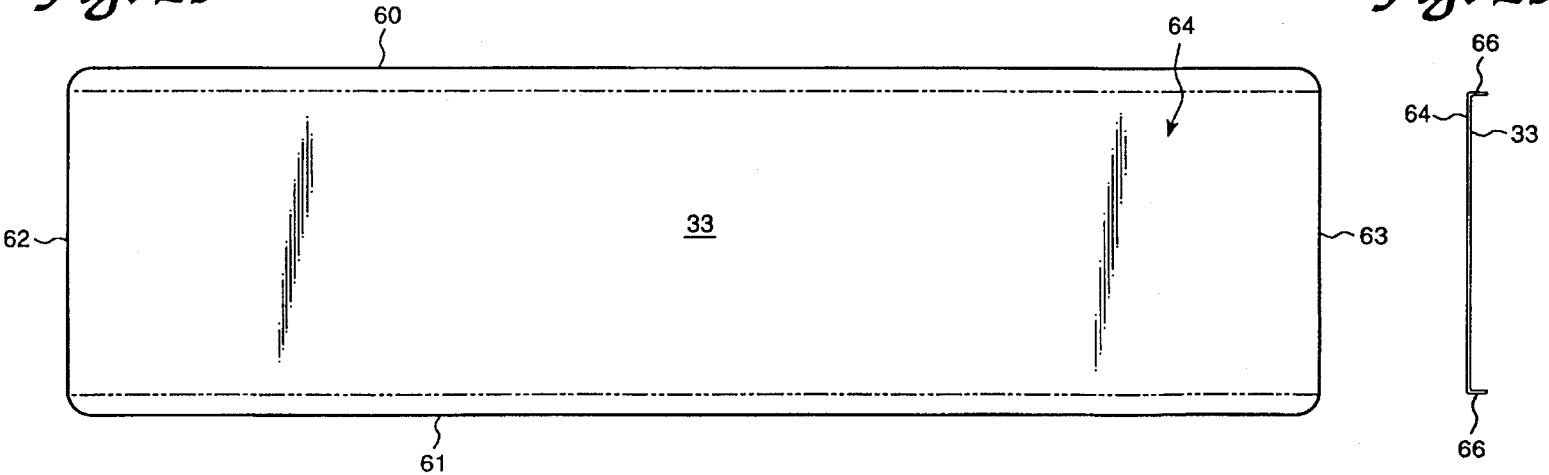
Fig. 2b'
Fig. 2b

EXPANDABLE DISPLAY DEVICE AND SPORTS CARD HOLDER

BACKGROUND OF THE INVENTION

1. Field of the Invention

The present invention relates to image bearing medium display devices, and in particular, to expandable display device and a card holder suitable for use in the expandable display device for displaying and protecting card-like objects.

2. Description of the Related Art

Collecting and trading image bearing memorabilia such as baseball, football, hockey cards, and the like, has long been and continues to be a popular hobby. As a result, old, rare, and unusual cards have become particularly valuable and the business of collecting and trading such cards has grown. Therefore, there is a need for a device capable of protecting the sports cards while also displaying them in an aesthetically pleasing fashion so that collectors can, for example, display their cards at home and traders can display their cards at card-trading shows and conventions. Furthermore, it is important that the sports card display system permit the interchanging of cards within the display system. Also, it is important that the display system be capable of accommodating a varying number of cards so that a collector can display cards added to his collection and/or tailor the displays to best present the cards to potential customers.

In one display system the individual cards are placed in pockets formed in a soft sheet of plastic. These sheets of plastic can then displayed on a binder or laid out on a flat surface, such as a table, at a card-trading exhibition. Such display systems, however, may not adequately protect the cards from bending and may not enable cards to be handled individually. Also, the plastic folders are not well suited to display cards on a vertical wall.

In another display system typified by U.S. Pat. Nos. 4,829,691; 5,010,673; 5,097,953; and 5,133,450, each card is individually placed within a rigid plastic holder formed from two transparent halves. It can be difficult, however, to maintain the two halves of the card holder together while keeping the card holder relatively small, lightweight, easy to handle, and aesthetically pleasing, and without distracting the observer from the card within the holder or obstructing the view of the card. To display a number of such holders, the holders are typically laid on a flat surface, such as a table, in a side-by-side fashion. This arrangement, however, may not be especially aesthetically pleasing so as to attract potential customers. Also, it can be difficult and ungainly to display a number of such holders on, for example, a vertical wall, and the individual card holders can be easily be lost or stolen. Furthermore, when a solid card holder is laid on a flat surface, it can be difficult to remove the holder from the surface. This is an important consideration to traders who want potential customers to be able to handle each card and the card holder individually with ease.

In another display system, taught by U.S. Pat. No. 5,082,122, a plurality of panels are provided and can be arranged into a three-dimensional display. Each card is placed in a holder, as just discussed above. The holder is then positioned between pegs extending from the panel surface and secured thereto by caps placed over the pegs. This display system enables a number of card holders to be displayed in a group, but it may not provide an optimum presentation of the cards and may not adequately protect the cards from damage. Two panels can be perpendicularly mounted together to form three dimensional arrangements by inserting a tab, projecting in the plane of a panel, in a slot provided in the surface of another panel. However, it is not possible to use this tab and slot arrangement to secure two panels together in a side-by-side relation for increasing the display area in two dimensions.

SUMMARY OF THE INVENTION

It is an object of the present invention to provide a display device and card holder, adapted to be used in combination to define a display system, which overcomes the problems associated with the other display devices as discussed above.

In accordance with the principles of the present invention, this objective is achieved by providing a display device comprising a primary backing panel, which includes top, bottom, first, and second edge portions, for receiving thereon at least one card holder. Associated with the primary backing panel is a frame providing a contiguous border around the periphery of the primary backing panel. The frame includes at least one top frame member selectively engaging the top edge portion of the primary backing panel, at least one side frame member selectively engaging the first edge portion, at least one bottom frame member selectively engaging the bottom edge portion, and at least another side frame member selectively engaging the second edge portion of the primary backing panel. The display device also includes an assembly for selectively securing at least one card holder to the primary backing panel and/or the frame.

While most conventional card holders can be adapted to be selectively secured to the above-described display device, the card holders best suited to be secured thereto includes two transparent panels. A channel is provided on an interior surface portion of one of the panels and positioned distance from the edge thereof. The other panel has a ridge on an interior surface portion cooperating with the channel to maintain the two panels in a surface-to-surface abutting relation so that the card-like object is held between the two panels. A pair of exterior slots are provided in both panels and aligned such that the slots provide a gripping portion enabling the card holder to be easily removed from a flat surface by inserting a portion a finger into said slot. The card holder also includes a separation assembly enabling the two panels to be easily separated from one another. Additionally, the card holder includes an attachment assembly for securing the card holder to the backing panel and/or the frame.

It is a further object of the present invention to provide an expandable display device and sports card holder which are simple in construction, economical in manufacture, and effective in operation.

The present invention may best be understood with reference to the accompanying drawings wherein an illustrative embodiment of the present invention is shown,

BRIEF DESCRIPTION OF THE DRAWINGS

FIGS. 2*a* and 2*a*' are a plan view and a side view, respectively of the first backing used in the display device of FIG. 1;

FIGS. 2*b* and 2*b*' are a plan view and a side view, respectively of the second backing used in the display device of FIG, 1;

DETAILED DESCRIPTION OF THE PRESENTLY PREFERRED EXEMPLARY EMBODIMENT

Figure 1B:
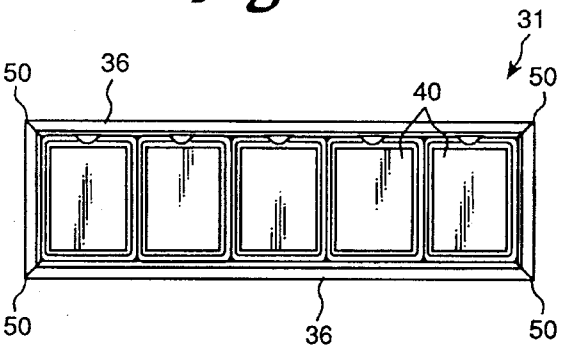
FIG. 1*b* is a plan view of the display system incorporating the display device shown in FIG. 1*a;*
Figure 1D:
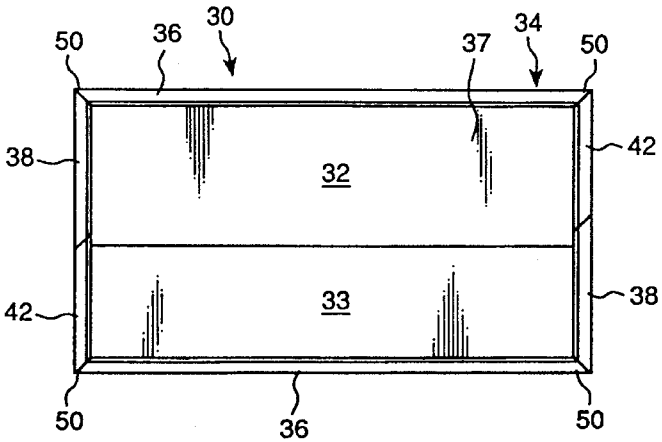
FIG. 1*d* is a plan view of the assembled display device shown in FIG. 1*c;*
Figure 1A:
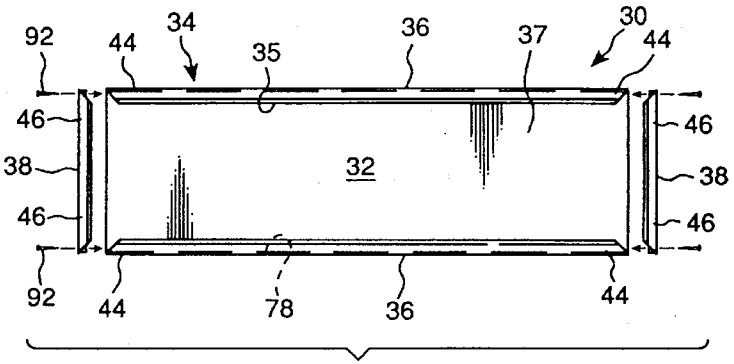
FIG. 1*a* is an exploded plan view of the expandable display device in it simplest, unexpanded form according to the principles of the present invention.

Referring now, more particularly, to FIGS. 1*a*–1*b*, there is shown therein an expandable display device, generally indicated at 30, which includes a primary backing panel 32 and an frame assembly, generally indicated at 34. As shown, in its simplest, non-expanded form the frame assembly 34 includes top and bottom frame members 36. Because the top and bottom members are identical in structure, they are designated by identical reference numerals. The frame assembly 34 also includes first and second side frame members 38. Because the side members are identical in structure, they are designated by identical reference numerals. The frame members 36 and 38 are disposed around the periphery of the primary backing panel 32 and engage one another at end portions thereof to hold the primary backing panel 32 within the frame assembly 34. Once assembled, as shown in FIG. 1*b*, the backing panel 32 is secured within the frame assembly 34 so that the display device 30 can receive a plurality of card holders 40 mounted to the display surface 37 of the backing 32, thereby defining a card holding display system, generally indicated at 31. The frame assembly 34 serves as a means for gripping the display device 30 so that the display system 31 can be handled without disturbing the card holders 40. The frame assembly 34 also serves to protect the card holders 40 from damage. The card holders 40 and the elements comprising the display device 30 are sized so that a predetermined number of card holders 40 can be mounted within the frame assembly 34 such that the edges of the card holders 40 are flush with the inner periphery 35 of the frame assembly 34 to thereby display card-like objects in each card holder 40 in an orderly and aesthetically pleasing manner.

The top and bottom members 36 are sized so as to define a first dimension of the frame assembly 34 and have beveled end portions 44. The end portions 44 are referred to as inwardly beveled because the surface of the beveled ends 44 can be seen when viewing the frame members 36 from the front, see FIG. 3*a*. The side frame member 38 also have inwardly beveled end portions 46 which engage the inwardly beveled end portions 44 of the first pair of frame members 36. The surfaces of the inwardly beveled end portions 44 and 46 are adapted to be engaged in a surface-to-surface abutting relation so as to from a generally 90° angle between the two frame members 36 and 38. When assembled, the inwardly beveled end portions of the first and second pair of frame members 36 and 38 form the corners 50 of the frame assembly 34.

Figure 1C:
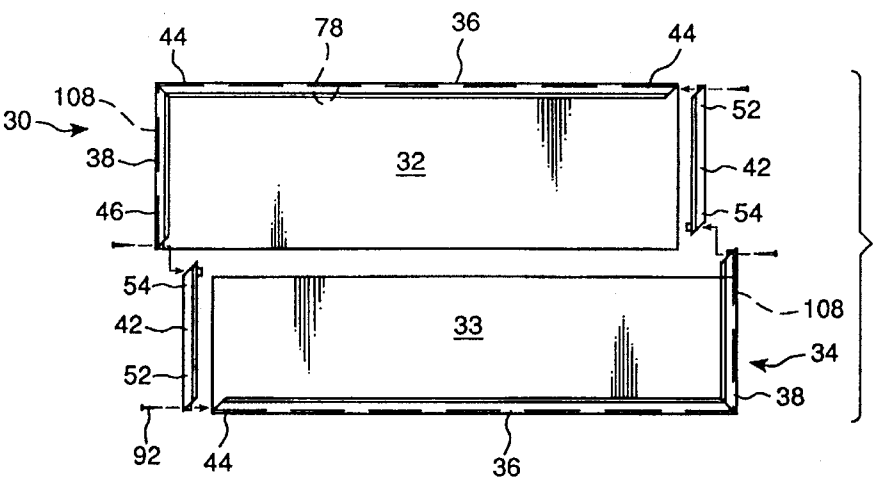
FIG. 1*c* is an exploded plan view of the display device showing the method by with the display device is expanded according to the principles of the present invention.

As shown in FIGS. 1*c*–1*d*, the size of the display device 30, including the display surface 37 on which the card holders are mounted, can be increased by providing an expansion assembly. The expansion assembly includes a secondary backing panel 33 positioned adjacent the primary backing panel 32 for increasing the size of the display surface 37, defined by the surface of the backings 32 and 33, on with the card holders 40 are selectively mounted. The frame assembly 34 can be expanded to accommodate the secondary backing 33 within the frame assembly 34, thereby maintaining a contiguous border around the periphery of the two backings 32 and 33. Backing 33 is held in an adjacent side-by-side relation with backing 32 by the frame assembly 34.

To expand the frame assembly 34, the expansion assembly also includes two extension frame members 42, identical in structure and referred to with like numerals, positioned on opposite sides of the frame assembly 34 and coaxially aligned with the side frame members 38. Each extension frame member 42 has an inwardly beveled end portion 52 and an outwardly beveled end portion 54. As shown, the inwardly beveled end portion 52 is adapted to engage an end portion 44 of the top and bottom frame members 36 to form a corner 50 of the frame assembly 34. The outwardly beveled end portion 54 engages the inwardly beveled end portion 46 of the side frame members 38 thereby forming a coaxial joint between the extension member 42 and the side frame member 38.

Figure 1G:
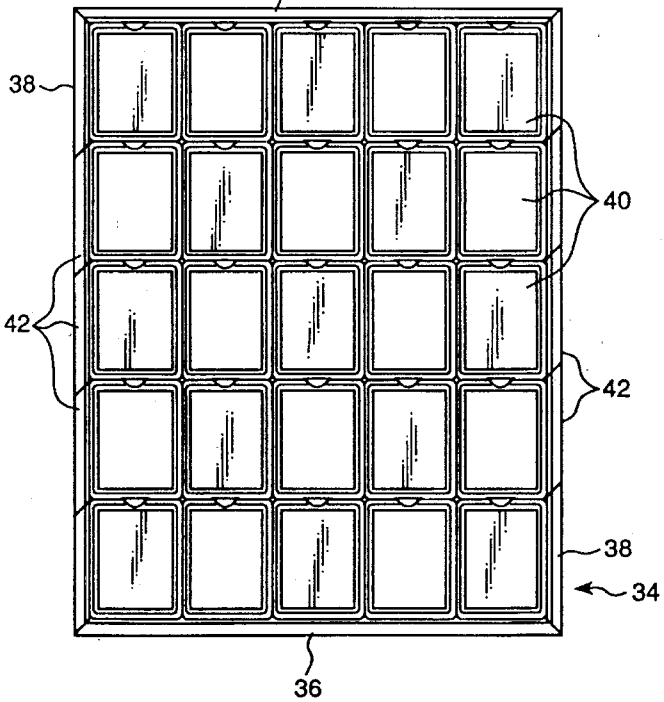
FIG. 1*g* a plan view of a display system according to the principles of the present invention.
Figure 1E:
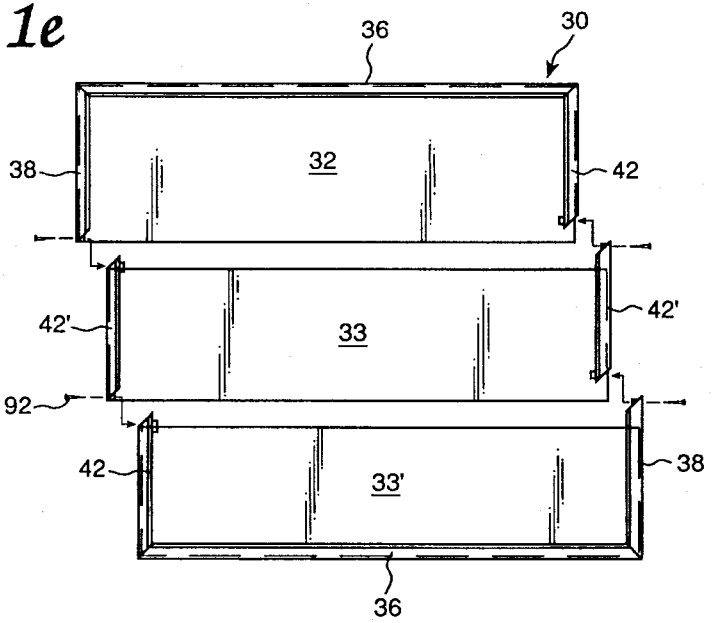
FIG. 1*e* is an exploded plan view of the display device showing further expansion of the display device.
Figure 1F:
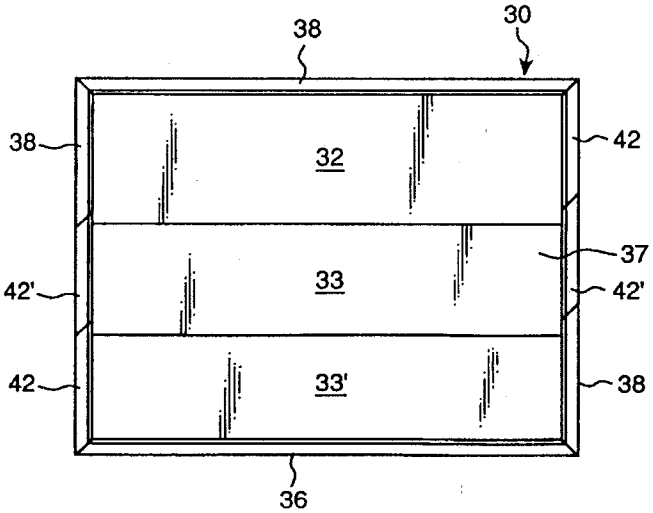
FIG. 1*f* is a plan view of the assembled display device shown in FIG. 1*e;*

As shown in FIGS. 1*e*–1*f*, the display device 30 can be still further expanded to accommodate another row of card holders (not shown). This is accomplished by using the same parts of the expansion assembly as discussed above. Specifically, another secondary backing panel 33' can be added adjacent to the existing backings 32 and 33, thereby increasing area of the display surface 37. Additional expansion frame members 42' engaged the sides of the backing and are provided between the second pair of frame members 38 and the previously added extension members 42. The "'" indicates that the element is identical to the element having the designated numeral and is provided for ease of illustration and description. It is to be understood that the expansion frame members 42 can be provided in any position along the sides of the frame assembly 34 such that a contiguous border is provided around the periphery of the backings 32. Furthermore, all of the frame members have a channel 78 and 108 (FIGS. 1*a* and 1*c*) along the inner periphery 35 of frame assembly 34 into which edges of the backings 32 and 33 are seated so that the backings 32 and 33 are held in an adjacent side-by-side relation. The display device can continue to be expanded as desired by attaching additional expansion assemblies in a manner similar to that just described.

FIG. 1*g* illustrates a preferred arrangement of the display system 29 which includes four expansion assemblies added to the basic display device 30 (FIG. 1*a*). In this arrangement the sides of the frame assembly 34 are extended so as to be larger than the top and bottom frame members 36. A plurality of card holders 40 are mountable within the frame assembly 34 onto the backings for displaying objects in an organized and aesthetically appealing fashion. It is to be understood that the display device 30, once assembled, can be mounted on a vertical surface or laid flat, thus enabling a plurality of card holders to be displayed in a frame system wherein the size of the frame system 29 can be varied to accommodate different numbers of card holders 40.

Referring now to FIGS. 2*a*, 2*a'*, 2*b* and 2*b'*, there is shown therein the backing panels 32 and 33 used in the display device 30 of FIGS. 1*a*–1*g*. The backing panels 32 and 33 have a generally rectangular shape, top, bottom, first, and second edge portions 60, 61, 62 and 63 respectively. In an exemplary embodiment of the present invention, the edges 60 and 61 are positioned in a generally perpendicular relation with respect to front surface 64 of the backing 32 and 33 to provide rigidity in the backing. As shown, first pair of edges 60 are bent at a generally right angle away from the front surface 64 of the backing 32 and 33 to form edge flaps 66. When the backings 32 and 33 are arranged in the display device, the edge flaps 66 fit within a channel 78 in the frame members 36, and the second edges 62 fit within a channel 108 in the frame members 38 (FIGS. 1*a* and 1*c*). When additional backings 33 and 33' are added to the display device 30 of FIGS. 1*a*–1*b*, the edge flaps 66 of adjacent backings 32, 33, and 33' abut one another in a surface-to-surface relation, with the edge flaps 66 extending toward the back of the display device to thereby provide a substantially planar display surface on the front of the backings 32 and 33 on which to mount the card holders. It is to be understood that the backings 32 and 33 may additionally be held together in the abutting relation by a fastener, such as a clasp or the like, between the two abutted together edge flaps 66. In an exemplary embodiment of the present invention, the backings 32 and 33 are made of metal so that the card holders can be magnetically mounted onto the backings 32 and 33. As shown in FIGS. 1*a*–1*b*, the backing 32 in the basic display device (without extensions) is sized large enough to fit within the channels of both frame members in the first pair of frame members 36. The secondary backings 33 have a slightly smaller width than the primary backing 32 in order to enable an additional row of the uniformly sized card holders 40 to be added to the expanded display device while maintaining the frame assembly 34 flush against the edges of the card holder 40. It is to be understood that two or more backings 32 and 33 could be replaced by a single larger backing.

Figure 3A:
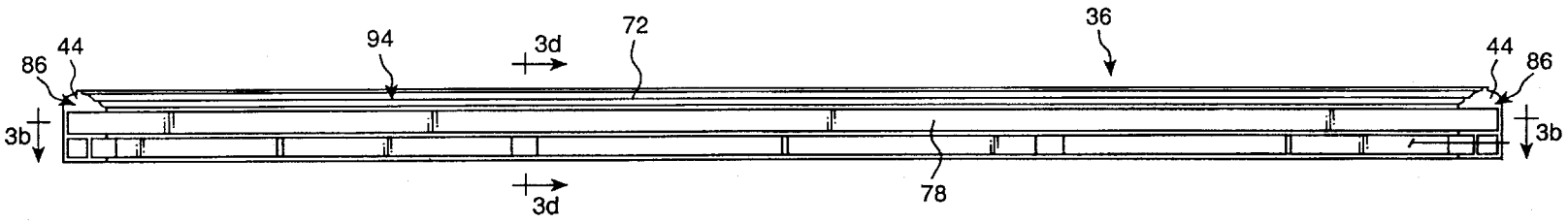
FIG. 3*a* is a front view of a frame member used in the display device shown in FIG. 1.

Referring now to FIGS. 3*a*–3*d*, there is shown therein a frame member 36 forming the top and bottom frame members 36 of the frame assembly. As shown in FIG. 3*a*, which is a front view of the frame member 36, the frame member 36 consists of a body member 72 having end portions 44. A backing receiving channel 78 extends the length of the body member 72 and is sized so as to accommodate and edge flap 66 (See FIGS. 2*a'* and 2*b'*) of the backings 32 and 33 therein. To hold the backings 32 and 33 within the channel 78, a number of threaded holes 80 are provided along the length of the body member 72 between the bottom surface 82 and the channel 78 generally perpendicular to the length of the channel 78. A screw 82 or other fastening device can be threaded through each hole 80 and tightened against the back side 84 of backing panel 32 or 33, see FIG. 3*d*, to secure the backing panel 32 or 33 against a surface of the channel 78. In addition to or in replace of the screw 82 a wedge may by provided between the backing 32 and a surface of the channel 78 for securing the backing to the frame.

Figure 3B:
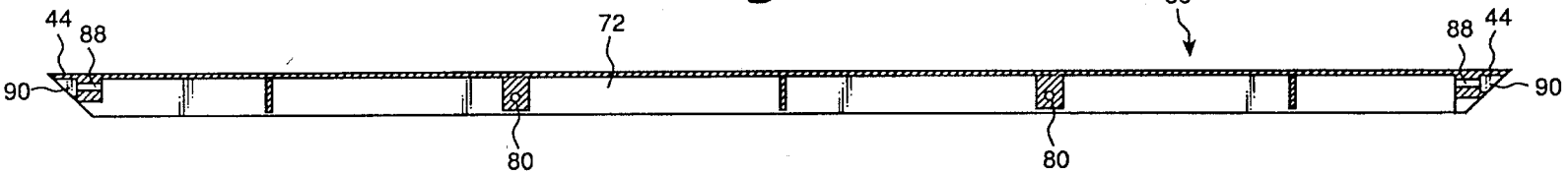
FIG. 3*b* is a sectional plan view of the frame member shown in FIG. 3*a;*
Figure 3D:
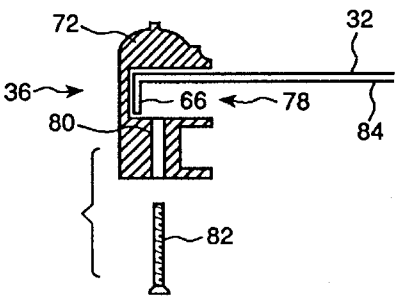
FIG. 3*d* is a sectional side view of the frame member shown in FIG. 3*a;*
Figure 3C:
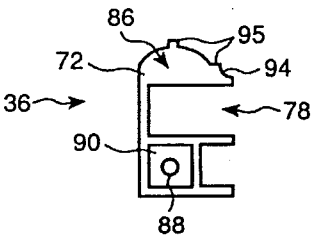
FIG. 3*c* is a side view of the frame member shown in FIG. 3*a;*
Figure 5A:
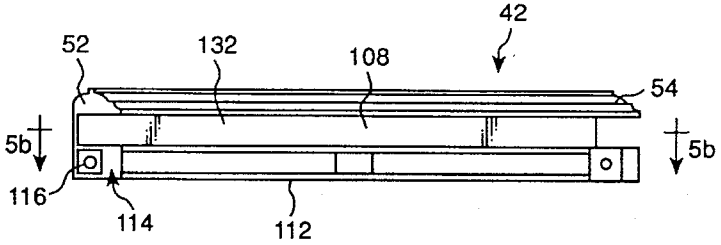
FIG. 5*a* is a front view of an extension frame member used in the display unit shown in FIG. 1.
Figure 5B:
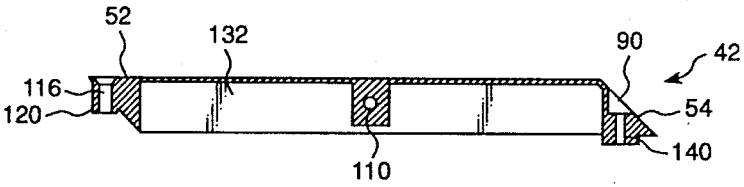
FIG. 5*b* is a sectional plan view of the extension frame member shown in FIG. 5*a;*
Figure 5C:
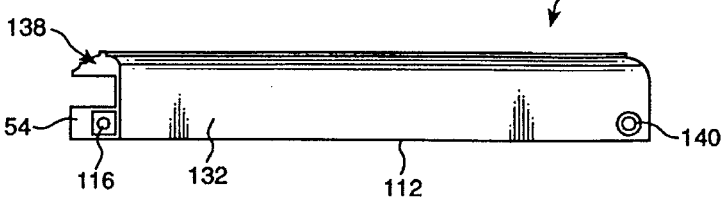
FIG. 5*c* is a back side view of the extension frame member shown in FIG. 5*a;*

As shown in FIGS. 3*a*–3*c*, the end portions 44 are inwardly beveled such that the surface 86 of the end portions 44 can be seen when viewing the frame members from the front of the body member 72. The inward bevel enables the end portions 44 to engage other inwardly beveled end portions of other frame members for forming generally right-angle corners 50 of the frame assembly 34, see FIG. 1. To secure the beveled end portions 44 to other frame member end portions (not shown), the end portions 44 include a threaded hole 88 and an alignment tab receiving receptacle, generally indicated at 90. The receptacle 90 is adapted to receive a protruding tab portion (not shown) of another frame member (not shown) therein. The two thus engaged frame members can then be secured to one another by means of a screw 92, see FIG. 1, rotatable within the threaded hole 88. The upper surface 94 of the body member 72, in an exemplary embodiment, includes ridges therein to enhance the aesthetic appearance of the display device and to enable the display device to be easily gripped and handled.

Figure 4A:
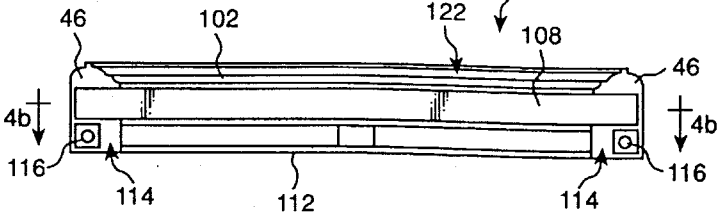
FIG. 4*a* is a front view of a second frame member used in the display device shown in FIG. 1.
Figure 4B:
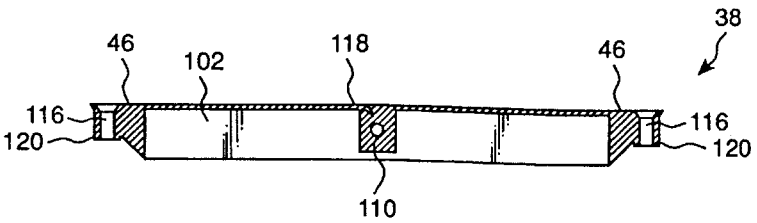
FIG. 4*b* is a sectional plan view of the second frame member/shown in FIG. 4*a;*
Figure 4C:
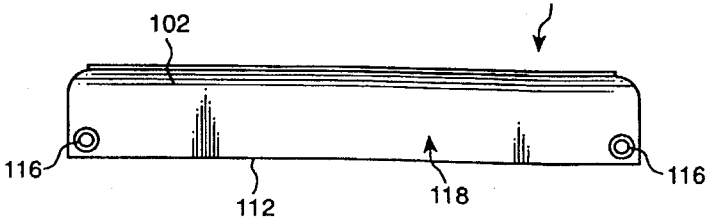
FIG. 4*c* is a back side view of the frame member shown in FIG. 4*a;*

Referring now to FIGS. 4*a*–4*c*, there is shown therein a frame member 38 in the pair of side frame members 38 of FIG. 1*a*. As shown in FIG. 4*a*, which is a front view of the frame member 38, the frame member 38 includes a body portion 102 having end portions 46. A backing receiving channel 108 extends the length of the body 102 and is sized so as to accommodate an edge 62 or 63 of the backing panel 32 and 33 (FIGS. 2*a*–2*b*) therein. To hold the backing (not shown) within the channel 108, at least one threaded hole 110 is provided along the length of the body member 102. The hole 110 enables a screw (not shown) to be threaded from the bottom surface 112 of the body member 102 into the channel 108 in a direction generally perpendicular to the length of the channel 108. The screw (not shown) maintains the backing in the channel in the same manner as discussed previously with respect to FIG. 3.

As shown in FIGS. *4a–4c*, the end portions 46 are inwardly beveled such that the surface 114 of the end portions 46 can be seen when the frame member 38 is viewed from the front of the body member 102. The inward bevel enables the end portions 46 of the frame member 38 to engage other frame members end portions (not shown) to thereby form corners 50 of the display device 34, (FIG. *1a–1b*). As shown in FIGS. *4a–4c*, the end portions 46 include holes 116 therethrough. The holes 116 extend from the rear surface 118 of the body member 102 to the surface 114 of the beveled end portion 46. A screw 92 (FIG. 1) can then be passed through the hole 116 and threaded into a threaded hole (not shown) in another frame member (not shown) to thereby secure two frame members together at their end portions. As shown, each end portion 46 includes an alignment tab 120 protruding from the surface 114. The tabs 120 are adapted to be fitted into tab receptacles 90 (FIG. 3) to facilitate assembly of the frame assembly 34 and to strengthen the joint formed by engagement of two end portions. The upper surface 122 of the body 102 includes ridges thereon to enhance the aesthetic appearance of the display device and to enable the display device to be easily gripped and handled.

Referring now to FIGS. *5a–5c*, there is shown therein an extension frame member 42, which consists of a body member 132 having first and second end portions 52 and 54. The extension frame member 42 is identical in structure to the frame member 38 (FIG. 4) except that the second end portion 54 is outwardly beveled such that the surface 138 of the second end portion 54 can be seen by viewing the body member 132 from the rear (FIG. *5c*). The outwardly beveled second end portion 54, when engaged with an inwardly beveled end portion of another frame member, as seen in FIG. 1, enables the extension frame member 42 to be coaxially attached to another frame member to thereby form a substantially straight joint therebetween. For example, the surface 138 of the outwardly beveled end portion 54 is capable of engaging the surface 114 of an end portion 46 of the frame member 38 as shown in FIG. 4. In such an arrangement, the frame members 42 and 38 are positioned such that the surfaces 102 and channels 108 are aligned with one another.

Referring again to FIGS. *5a–5c*, the second end portion 54 is secured to another inwardly beveled end portion (not shown) by providing a threaded hole 140 into which a screw 92 (FIG. 1) is provided for securing the two end portions together. The second end portion 54 also includes an alignment tab receiving receptacle, generally indicated at 90, which is identical to the receptacle 90 on the end portions 44 of the frame member 36 of FIG. 3. The receptacle 90 receives a tab portion (not shown) from another frame member (not shown) to facilitate assembly of the display device and to form a strong joint between and portions of the two adjacent engaging frame members.

While the preferred embodiment shows the display device 34 expandable in a one direction, it is to be understood that additional frame members may be provided so as to expand the display device in a second direction. For example, the first pair of frame members 36 could include a beveled end portion arrangement that enables additional frame member to be added thereto. Furthermore, it is contemplated by the present invention that the display device could be expanded in both the first and second directions by attaching additional backings and frame members to the first and second pair of opposing frame members 36 and 38 of the display device 30. While the present invention has been described above in terms of adding frame members and backings to increase the size of the display device, it is to be understood that the additional frame members and backings could also be removed from the display device 30 to thereby decrease the size of the display device 30.

Figure 6:
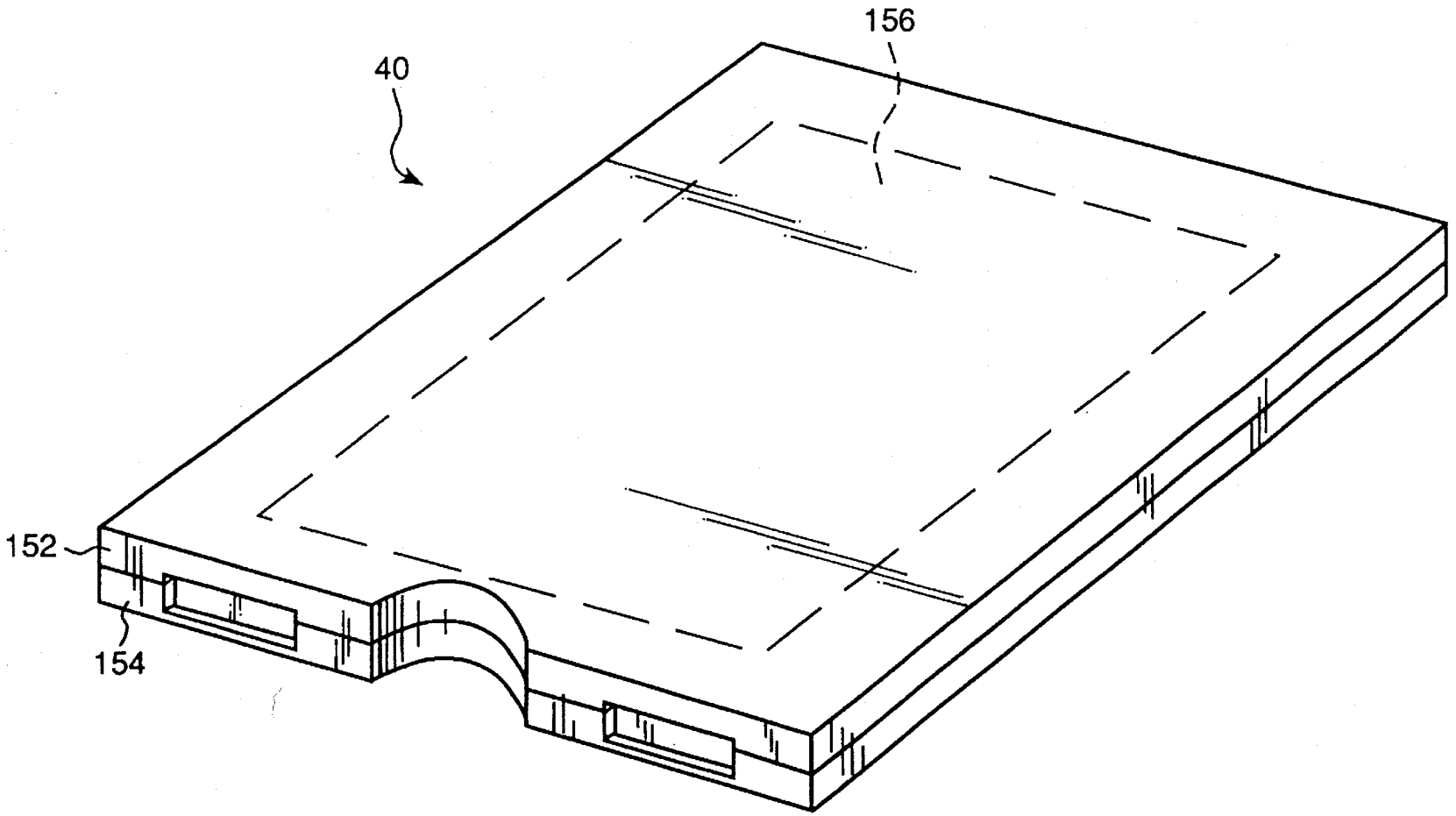
FIG. 6 is a perspective view of the sports card holder according to the principles of the present invention.
Figure 7C:
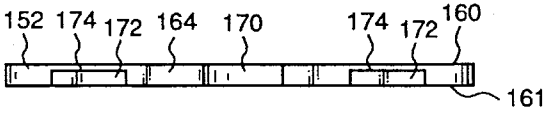
FIG. 7*c* is a top view of the first panel shown in FIG. 7*a;*
Figure 7B:
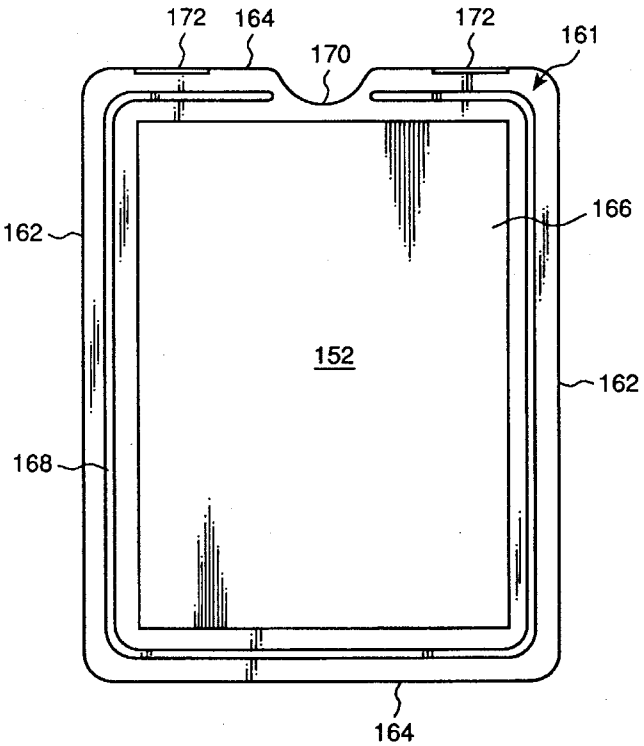
FIG. 7*b* is a rear view of the first panel shown in FIG. 7*a;*
Figure 7D:
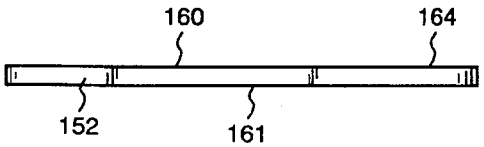
FIG. 7*d* is a bottom view of the first panel shown in FIG. 7*a;*
Figure 7A:
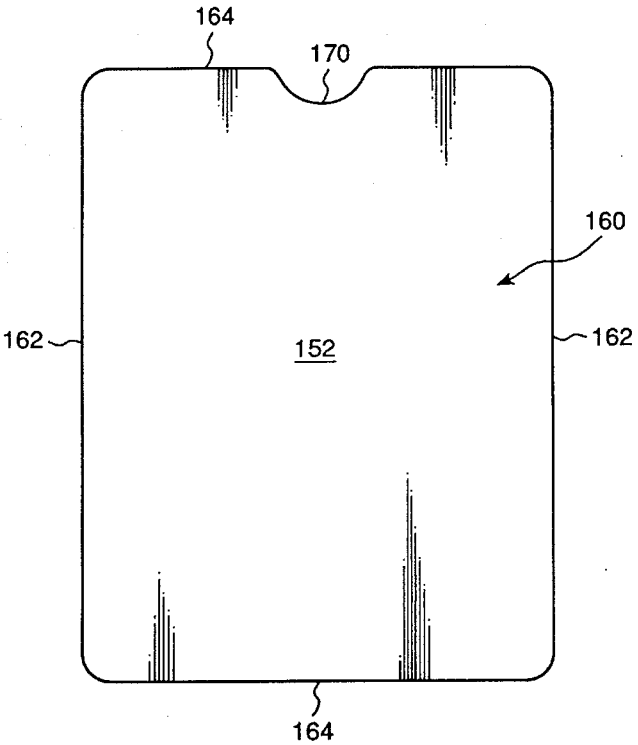
FIG. 7*a* is a front view of a first panel of the sports card holder shown in FIG. 6.
Figure 8C:
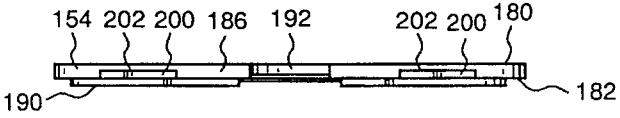
FIG. 8*c* is a top view of the second panel shown in FIG. 8*a;*
Figure 8B:
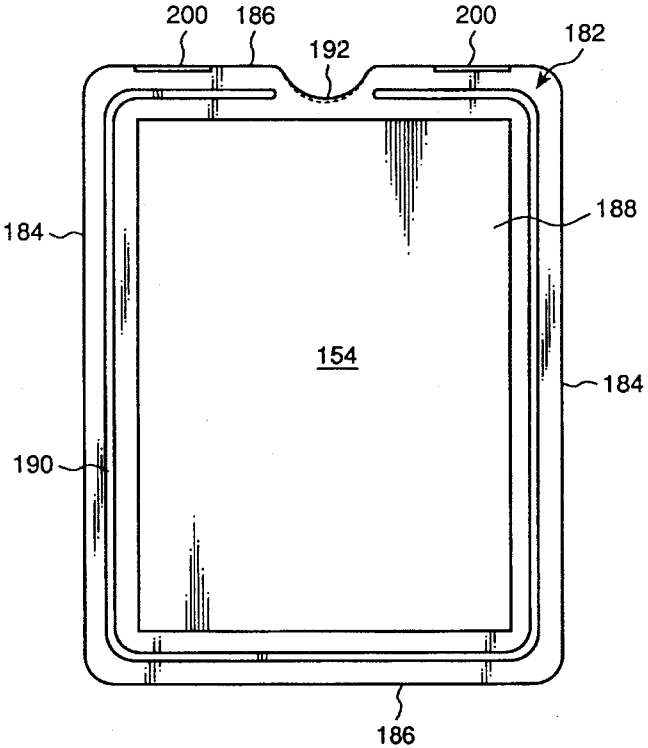
FIG. 8*b* is a rear view of the second panel shown in FIG. 8*a;*
Figure 8D:
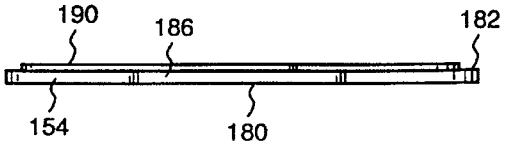
FIG. 8*d* is a bottom view of the second panel shown in FIG. 8*a;*
Figure 8A:
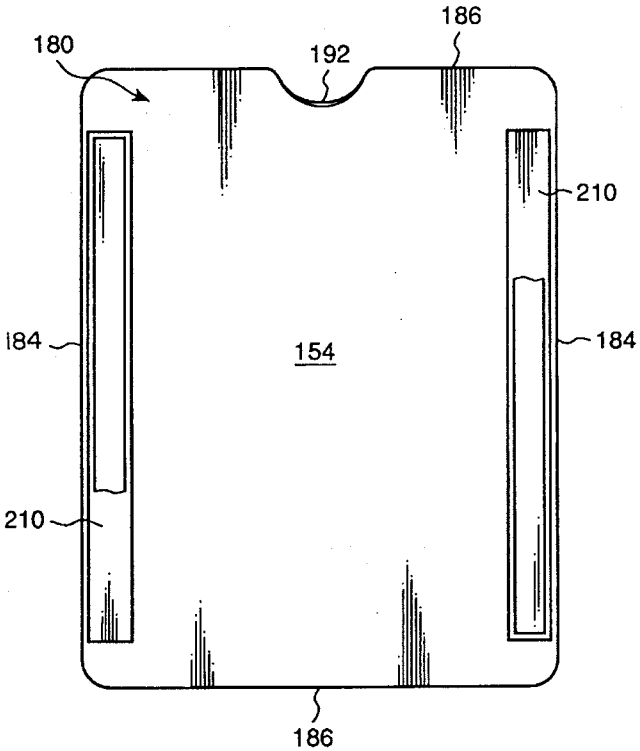
FIG. 8*a* is a front view of the second panel of the sports card holder shown in FIG. 6.

Referring now to FIG. 6, there is shown therein a card holder 40 suitable for use with the above-described display device 30 to thereby define a display system 31 (FIG. 1) for displaying card-like objects 156, such as baseball, football, and hockey cards, or the like. The card holder 40 includes a first transparent panel 152 and a second transparent panel 154 engaging one another such that the card-like object 156 is held between the two panels 152 and 154. The panels 152 and 154 have similar sizes and shapes so that they match one another to form a unitary card holding device 40 when so engaged.

Referring now to FIGS. *7a–7d* and 10, there is shown therein the first transparent panel 152 of the card holder 40. As shown, the first panel 152 includes an exterior surface 160, an interior surface 161, a first pair of opposing edges 162, and a second pair of opposing edges 164. The interior surface 161 includes a recessed portion 166 sized so as to accommodate a card-type object therein. The panel 152 also has a channel 168 in the interior surface 161 disposed between the recessed portion 166 and the edges 162 and 164 of the panel 152. The channel 168 is generally parallel to the edges 162 and 164 and positioned a distance therefrom. The upper portion of the panel 152 has a slot 170 therein which extends from the edge 164 toward the center of the panel 152. The slot 170 is sized to as to enable a person to insert of a portion of a finger into the slot 170 to thereby make it easier to grasp the card holder 40 and remove to it from a flat surface, such as the display surface 37 of the display device 30 (FIG. *1d*). The upper edge 164 of the panel 152 also includes a pair of grooves 172 on opposite sides of the slot 170. The grooves 172 include a first side wall 174 proximate to the exterior surface 160 of the panel 152 and a width extending through the edge 164 to the interior surface 161 of the panel 152.

Figure 9:
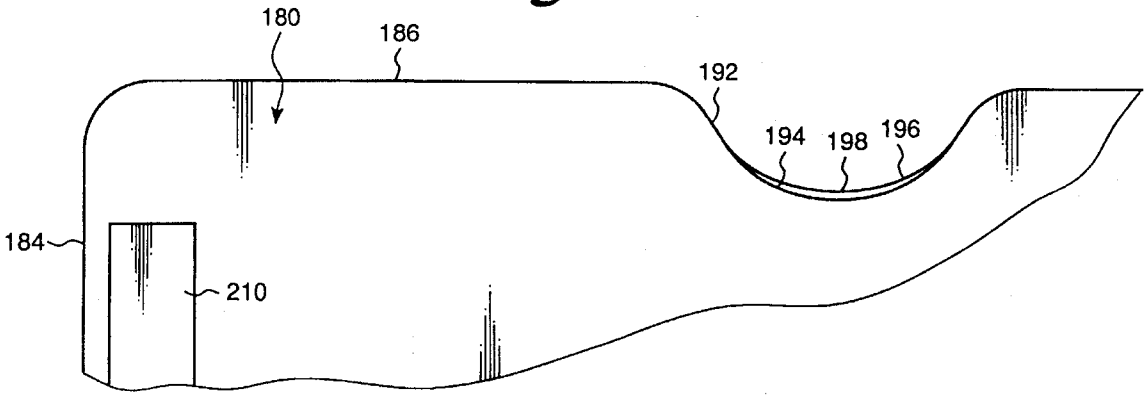
FIG. 9 is a fragmented rear view of an upper portion of the second panel shown in FIG. 8*a;*

Referring now to FIGS. *8a–8d* and 10, there is shown therein the second transparent panel 154 of the card holder 40. As shown, the second panel 154 includes an exterior surface 180, an interior surface 182, a first pair of opposing edges 184, and a second pair of opposing edges 186. The interior surface 182, which engages the interior surface 161 of the first panel 152, includes a protruding portion 188 capable of cooperating with the recessed portion 166 of the first panel 152 such that the surface of the recessed portion 166 and the surface of the protruding portion 188 are spaced a distance apart generally equal to the thickness of the card-type object when the panels 152 and 154 are engaged. The protruding portion 188 serves to maintain the card-like object within the recessed portion 166. The second panel 154 has a ridge 190 disposed between the protruding portion 188 and the edge 184 and 186 of the panel 154. The ridge 190 is positioned a distance from edges 184 and 186 and generally parallel thereto. The ridge 190 is sized such that the sides of the ridge 190 engage the sides of the channel 168 in the first panel 152 thereby holding the first and second panels 152 and 154 together due to the pressure and friction between the sides of the channel 168 and the sides of the ridge 190. The upper portions of the second panel 154 has a slot 192 therein extending from the edge 186 toward the center of the panel 154. The slot 192 is sized so as to match the slot 170 in the first panel 152 to make gripping the card holder easier, especially when removing the card holder 100 from a flat surface, such as the backing panels 32 and 33 of FIGS. 1–3. As shown in FIG. 9, the slot 192 has an outside edge 194 and an inside edge 196 which form a friction edge 198 therebetween. The ridge 198 faces the rear of the card holder 40 when the first and second panel 152 and 154 are engaged and enables the slot to be more easily gripped for removing the card holder from the flat backing panels 32 and 33 in the display device 30.

Figure 11:
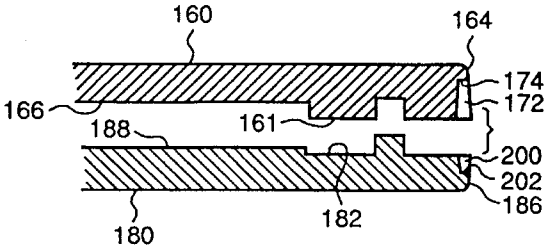
FIG. 11 is a fragmented sectional view of a top portion of the first and second panels of the sports card holder.

Referring to FIGS. 8*a*–8*d*, and 11, the upper edge 186 of the panel 154 also includes a pair of grooves 200 on opposite sides of the slot 192 and positioned adjacent the groove 172 in the first panel 152 when the two panels 152 and 154 are together. The groove 200 has a front side wall 202 proximate to the exterior surface 180 of the second panel 154 and a width extending through the edge 186 to the interior surface 182 of the second panel 154. As best seen in FIG. 11, the grooves 172 and 200 facilitate the separation of the two panels 152 and 154, which is accomplished by placing an object, such as a coin or the like, into one of the pairs of grooves 172 and 200. Rotating the object causes a force to be applied to the first side walls 164 and 202 to move the panels 152 and 154 away from one another.

Figure 10:
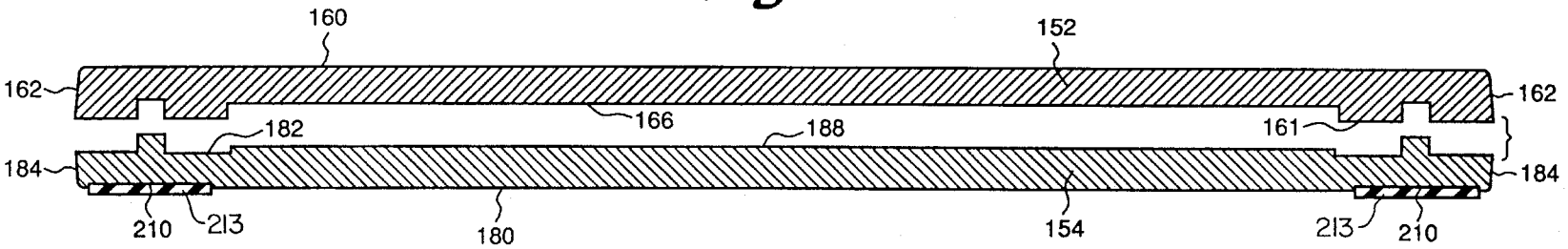
FIG. 10 is a cross-sectional view of the sports card holder shown in FIG. 6 showing the engaging relationship of the first and second panels.

Referring again to FIGS. 8*a* and 10, the second panel 154 includes a pair of grooves 210 on the exterior surface 180 thereof. The grooves 210 are provided so that magnetic strips 213, which are partially shown in FIG. 8*a*, can be positioned therein and affixed within the grooves by any conventional method, such as glue or the like. The magnetic strips 213 enable the card holder 40 to be magnetically mounted to the metal backing panels 32 and 33 as shown in FIGS. 2*a*, 2*a*', 2*b*, and 2*b*'.

It is to be understood that while the preferred embodiment of the card holder according to the principles of the present invention has been described above, it is contemplated that the various features, such as the pair of slots 170 and 192, the ridge 190 and channel 168 combination, and the pair of grooves 172 and 200 may be provided at various locations of the panels 152 and 154 other than those described above.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. An expandable display device adapted to receive a plurality of holders for card-like objects, said display device comprising:

a primary backing panel having top, bottom, first, and second edge portions;

a secondary backing panel having top, bottom, first, and second edge portions, wherein said top edge portion of said secondary panel is positioned adjacent said bottom edge portion of said primary backing panel to form a display surface defined by a surface of said primary backing panel and a surface of said secondary backing panel;

a frame assembly providing a contiguous border around said display surface, said frame assembly comprising:

a top frame member engaging said top edge portion of said primary backing panel, a first side frame member engaging said first edge portion of said primary backing panel, and a second side frame member engaging said second edge portion of said secondary backing panel, a first side frame element engaging said second edge portion of said primary backing panel, and a second side frame element engaging said first edge portion of said secondary backing panel, a bottom frame member engaging said bottom edge portion of said secondary backing panel, wherein each of said first and second side frame members, said first and second side frame elements, and said top and bottom frame members has a channel defined therein for receiving a respective edge portion of one of said primary backing panel and said secondary panel to support said primary and secondary backing panels, wherein each end of said top frame member, said bottom frame member, said first side frame member and said second side frame is inwardly beveled, and wherein a first end of each of said first side frame element and said second side frame element is inwardly beveled and a second end of each of said first side frame element and said second side frame element is outwardly beveled;

fastening means for securing said end portions of adjacent elements in said frame assembly directly to one another; and means for securing at least one card holder to at least one of said primary backing panel and said secondary backing panel.

2. An expandable display device as defined in claim 1, wherein said first side frame member and said second side frame member have substantially identical configurations and said first side frame element and said second side frame element have substantially identical configurations.

3. An expandable display device as defined in claim 2 wherein said at least one top frame member includes one frame member, and said at least one bottom frame member includes one frame member.

4. An expandable display device as defined in claim 1, wherein said first frame member has a configuration substantially identical to said second side frame member.

5. An expandable display device as defined in claim 1, wherein said first frame element has a configuration substantially identical to said second side frame element.

6. An expandable display device as defined in claim 1, wherein said fastening means comprises a threaded hole in said end portion of a first frame member, a hole in an end portion of a second frame member, and a screw positioned within said threaded hole and said hole for securing said first and second frame members at said end portions thereof.

7. An expandable display device as defined in claim 1, further comprising a backing panel attachment assembly for selectively securing said primary and secondary backing panels within said channel.

8. An expandable display device as defined in claim 7, wherein said backing panel attachment assembly includes at least one threaded hole extending from an exterior surface portion of each frame member into said channel in a direction generally perpendicular to said channel and a screw threaded therein securing said backing panel within said channel.

9. An expandable display device as defined in claim 1, wherein said primary and secondary backing panels are metal, generally rectangular shaped, and said top and bottom edge portions of each of said primary and said secondary backing panels are bent at an angle with respect to said surface of said primary backing panel and said surface of said secondary backing panel respectively, said channel in said frame members being sized for receiving said bent edge portions therein, and said primary and said second backing panels being further secured to one another along abutting edges thereof by at least one fastening device.

10. An expandable display device as defined in claim 1, further comprising:

an intermediate backing panel having top, bottom, first, and second edge portions, said at least one intermediate backing panel being disposed between said primary and secondary backing panels such that said bottom edge portion of said primary backing panel abuts said top edge portion of said intermediate backing panel and said top edge portion of said secondary backing panel abuts said bottom edge portion of said intermediate backing panel to form a display surface defined by said surface of said primary backing panel, said surface of said bottom backing panel, and a surface of said intermediate backing panel, and wherein said frame assembly further comprises:

a first side frame component engaging said first edge portion of said intermediate backing panel, and a second side frame component engaging said second edge portion of said intermediate backing panel, each of said first and second side frame components having a channel defined therein for receiving a respective edge portion of said intermediate backing panel therein to support said backing panels, and each of said first and second side frame components having a configuration substantially identical to that of said first and second side frame elements.

11. A card holder suitable for holding and displaying card-like objects, said card holder comprising:

a transparent first panel and a transparent second panel, said first and second panels having sizes and shapes substantially matching one another;

a recessed portion in one of said first and second panels on an interior surface portion thereof, said recessed portion sized so as to receive a card-like object therein, a remaining other of said first and second panels having a protruding portion in an interior surface portion thereof, said protruding portion cooperating with said recessed portion when said first and second panels are in an engaged relation for holding said card-like object within said recessed portion between said panels;

a channel on said interior surface portion of one of said first and second panels, said channel being positioned a distance from an edge of said panel, and a remaining other of said first and second panels having a ridge on said interior surface portion thereof at a distance from an edge thereof, said ridge cooperating with said channel to maintain said first and second panels in a surface-to-surface abutting relation;

a first indentation defined in a peripheral edge of said first panel and a second indentation defined in a peripheral edge of said second panel, said first indentation extending entirely through a thickness of said first panel and said second indentation extending entirely through a thickness of said second panel, said first indentation in said first panel being positioned adjacent to said second indentation in said second panel when said first panel and said second panel are engaged in a surface-to-surface abutting relation so as to define a cut-out portion in a peripheral edge of said card holder, said cut-out portion extending a thickness of said card holder thereby providing a gripping portion enabling said card holder to be manually grasped by inserting a portion of a finger into said cut-out portion;

a separation assembly facilitating separation of said first and second panels from one another; and an attachment assembly for securing said card holder to a surface.

12. A card holder as defined in claim 11, wherein said separation assembly includes at least one groove on an edge of said card holder, said groove having a first side wall formed in said first panel and a second side wall formed in said second panel enabling an object placed within said groove and rotated therein to apply a force to each side wall to separate said first and second panels from one another.

13. A card holder as defined in claim 11, wherein said attachment assembly includes a pair of channels in an exterior surface of one of said first and second panels, and a pair of magnets affixed within said pair of channels.

14. A card holder as defined in claim 11, wherein one of said first and second indentations includes a friction ridge therein.

15. A display system suitable to display and protect card-like objects, said display system comprising: an expandable display device comprising:

(1) a primary backing panel for receiving thereon at least one card holder, said primary backing panel including top, bottom, first, and second edge portions;

(2) a frame assembly for providing a contiguous border around a periphery of said primary backing panel, said frame assembly including at least one top frame member engaging said top edge portion of said primary backing panel, at least one bottom frame member engaging said bottom edge portion, at least one primary side frame member engaging said first edge portion, and at least one secondary side frame member engaging said second edge portion of said primary backing panel; and (3) a means for securing at least one card holder to at least one of said primary backing panel and said frame assembly; and at least one card holder selectively mounted onto said primary backing panel, each of said card holders comprising:

(1) a transparent first panel and a transparent second panel, said first and second panels having sizes and shapes substantially matching one another;

(2) a recessed portion in one of said first and second panels on an interior surface portion thereof, said recessed portion sized so as to receive a card-like object therein, a remaining other of said first and second panels having a protruding portion in an interior surface portion thereof, said protruding portion cooperating with said recessed portion when said first and second panels are in an engaged relation for holding said card-like object within said recessed portion between said panels;

(3) a channel on said interior surface portion of one of said first and second panels, said channel being positioned a distance from an edge of said panel, and a remaining other of said first and second panels having a ridge on said interior surface portion thereof at a distance from an edge thereof, said ridge cooperating with said channel to maintain said first and second panels in a surface-to-surface abutting relation;

(4) a first indentation defined in a peripheral edge of said first panel and a second indentation defined in a peripheral edge of said second panel, said first indentation extending entirely through a thickness of said first panel and said second indentation extending entirely through a thickness of said second panel, said first indentation in said first panel being positioned adjacent to said second indentation in said second panel when said first panel and said second panel are engaged in a surface-to-surface abutting relation so as to define a cut-out portion in a peripheral edge of said card holder, said cut-out portion extending a thickness of said card holder thereby providing a gripping portion enabling said card holder to be manually grasped by inserting a portion of a finger into said cut-out portion;

(5) a separation assembly facilitating separation of said first and second panels from one another; and (6) an attachment assembly for securing said card holder to said primary backing panel.

16. A display system as defined in claim 15, further comprising:

a least one secondary backing panel having top, bottom, first, and second edge portions, wherein said top edge portion of said at least one secondary panel is selectively positioned adjacent said bottom edge portion of said primary backing panel to form a display surface defined by a surface of said primary backing panel and a surface of said at least one secondary backing panel; and said frame assembly further comprises at least one primary side frame element and at least one secondary side frame element selectively engaging first and second edge portions, respectively, of said secondary backing panels, wherein said bottom frame member selectively engages said bottom edge portion of a lowermost of said backing panels whereby when said at least one secondary backing panel is positioned adjacent said primary backing panel said frame assembly respectively engages to free edges of said backing panels to maintain said contiguous border around said display surface.

17. An expansion assembly adapted to increase a size of a display device formed from a primary backing panel having top, bottom, first and second edge portions and a frame assembly including a top frame member engaging said top edge portion of said primary backing panel, a first side frame member engaging said first edge portion of said primary backing panels, a bottom frame member engaging said bottom edge portion of said primary backing panel, and a second side frame member engaging said second edge portion of said primary backing panel, each of said first and second side frame members, said top frame member and said bottom frame members having a channel defined therein for receiving a respective edge portion of said primary backing panel therein to thereby support said primary backing panel, wherein each end of said first and second side frame members and said top and bottom frame members is inwardly beveled, member and said bottom frame members having end portions, said expansion assembly comprising:

a secondary backing panel having top, bottom, first, and second edge portions, wherein said top edge portion is selectively positioned adjacent said bottom edge portion of said primary backing panel to form a display surface defined by a surface of said primary backing panel and a surface of said secondary backing panel wherein said bottom frame member associated with said bottom edge portion of said primary backing panel is removed therefrom and disposed in an engaging relation with said bottom edge portion of said secondary backing panel;

a first side frame element selectively engaging said second edge portion of said primary backing panel, wherein said second side frame member is removed therefrom and disposed in an engaging relation with said second edge portion of said secondary backing panel;

a second side frame element selectively engaging said first edge portion of said secondary backing panel, said first and second side frame elements having a channel defined therein for receiving a respective edge portion of one of said primary backing panel and said secondary backing panel so as to support said backing panels, wherein a first end of each of said first side frame element and said second side frame element is inwardly beveled and a second end of each of said first side frame element and said second side frame element is outwardly beveled; and fastening means for securing said end portions of adjacent frame members and frame elements directly to one another.

18. A display system suitable to display and protect card-like objects, said display system comprising:

(a) a display device comprising:

a primary backing panel for receiving thereon at least one cardholder; and a frame assembly for providing a contiguous border around a periphery of said primary backing panel; and (b) at least one cardholder selectively mounted to said primary backing panel, each said cardholder comprising:

(1) a transparent first panel and a transparent second panel, said first and second panels having sizes and shapes substantially matching one another;

(2) a recessed portion in one of said first and second panels on an exterior surface portion thereof, said recessed portion sized so as to receive a card-like object therein, a remaining other of said first and second panels having a protruding portion in an exterior surface portion thereof, said protruding portion cooperating with said recessed portion when said first and second panels are in an engaged relation for holding said card-like object within said recessed portion between said panels;

(3) a channel on an interior surface portion of one of said first and second panels, said channel being positioned a distance from an edge of said panel, and a remaining other of said first and second panels having a ridge on said interior surface portion thereof at a distance from an edge thereof, said ridge cooperating with said channel to maintain said first and second panels in a surface-to-surface butting relation;

(4) a first indentation defined in a peripheral edge of said first panel and a second indentation defined in a peripheral edge of said second panel, said first indentation extending entirely through a thickness of said first panel and said second indentation extending entirely through a thickness of said second panel, said first indentation in said first panel being positioned adjacent to said second indentation in said second panel when said first panel and said second panel are engaged in a surface-to-surface abutting relation so as to define a cut-out portion in a peripheral edge of said card holder, said cut-out portion extending a thickness of said card holder thereby providing a gripping portion enabling said card holder to be manually grasped by inserting a portion of a finger into said cut-out portion;

(5) a separation assembly facilitating separation of said first and second panels from one another; and (6) an attachment assembly for securing said cardholder to said primary backing panel.

19. A display system suitable to display and protect card-like objects, said display system comprising: an expandable display device comprising:

(1) a primary backing panel for receiving thereon at least one card holder, said primary backing panel including top, bottom, first, and second edge portions;

(2) a least one secondary backing panel having top, bottom, first, and second edge portions, wherein said top edge portion of said at least one secondary panel is positioned adjacent said bottom edge portion of said primary backing panel to form a display surface defined by a surface of said primary backing panel and a surface of said at least one secondary backing panel;

(3) a frame means for providing a contiguous border around a periphery of said primary backing panel, said frame means including:

at least one top frame member engaging said top edge portion of said primary backing panel, at least one bottom frame member engaging said bottom edge portion, at least one primary side frame member engaging said first edge portion, at least one secondary side frame member engaging said second edge portion of said primary backing panel, and at least one primary side frame element and at least one secondary side frame element engaging first and second edge portions, respectively, of said secondary backing panels, wherein said bottom frame member engages said bottom edge portion of a lowermost of said backing panels whereby when said at least one secondary backing panel is positioned adjacent said primary backing panel said frame means respectively engages outermost edges of said backing panels to maintain said contiguous border around said display surface; and (4) a means for securing at least one card holder to at least one of said primary backing panel and said frame means; and at least one card holder selectively mounted onto said primary backing panel, each of said card holders comprising:

(1) a transparent first panel and a transparent second panel, said first and second panels having sizes and shapes substantially matching one another;

(2) a recessed portion in one of said first and second panels on an interior surface portion thereof, said recessed portion sized so as to receive a card-like object therein, a remaining other of said first and second panels having a protruding portion in an interior surface portion thereof, said protruding portion cooperating with said recessed portion when said first and second panels are in an engaged relation for holding said card-like object within said recessed portion between said panels;

(3) a channel on said interior surface portion of one of said first and second panels, said channel being positioned a distance from an edge of said panel, and a remaining other of said first and second panels having a ridge on said interior surface portion thereof at a distance from an edge thereof, said ridge cooperating with said channel to maintain said first and second panels in a surface-to-surface abutting relation;

(4) a pair of exterior slots in an edge of said first and second panels, said slots being positioned adjacent one another when said panels are engaged in surface-to-surface abutting relation providing a gripping portion enabling said card holder to be manually grasped by inserting a portion a finger into said slot;

(5) a separation assembly facilitating separation of said first and second panels from one another; and (6) an attachment assembly for securing said card holder to said primary backing panel.

20. A card holder suitable for holding and displaying card-like objects, said card holder comprising:

a transparent first panel and a transparent second panel, said first and second panels having sizes and shapes substantially matching one another;

a recessed portion in one of said first and second panels on an interior surface portion thereof, said recessed portion sized so as to receive a card-like object therein, a remaining other of said first and second panels having a protruding portion in an interior surface portion thereof, said protruding portion cooperating with said recessed portion when said first and second panels are in an engaged relation for holding said card-like object within said recessed portion between said panels;

means for maintaining said first panel and said second panel in a surface-to-surface abutting relation;

a first indentation defined in a peripheral edge of said first panel and a second indentation defined in a peripheral edge of said second panel, said first indentation extending entirely through a thickness of said first panel and said second indentation extending entirely through a thickness of said second panel, said first indentation in said first panel being positioned adjacent to said second indentation in said second panel when said first panel and said second panel are engaged in a surface-to-surface abutting relation so as to define a cut-out portion in a peripheral edge of said card holder, said cut-out portion extending a thickness of said card holder thereby providing a gripping portion enabling said card holder to be manually grasped by inserting a portion of a finger into said cut-out portion;

a separation assembly facilitating separation of said first and second panels from one another; and an attachment assembly for securing said card holder to a surface.

21. A display system suitable to display and protect card-like objects, said display system comprising:

an expandable display device comprising:

(1) a primary backing panel for receiving thereon at least one card holder, said primary backing panel including top, bottom, first, and second edge portions;

(2) a frame assembly for providing a contiguous border around a periphery of said primary backing panel, said frame assembly including at least one top frame member engaging said top edge portion of said primary backing panel, at least one bottom frame member engaging said bottom edge portion, at least one primary side frame member engaging said first edge portion, and at least one secondary side frame member engaging said second edge portion of said primary backing panel; and (3) a means for securing at least one card holder to at least one of said primary backing panel and said frame assembly; and at least one card holder selectively mounted onto said primary backing panel, each of said card holders comprising:

(1) a transparent first panel and a transparent second panel, said first and second panels having sizes and shapes substantially matching one another;

(2) a recessed portion in one of said first and second panels on an interior surface portion thereof, said recessed portion sized so as to receive a card-like object therein, a remaining other of said first and second panels having a protruding portion in an interior surface portion thereof, said protruding portion cooperating with said recessed portion when said first and second panels are in an engaged relation for holding said card-like object within said recessed portion between said panels;

(3) means for maintaining said first panel and said second panel in a surface-to-surface abutting relation;

(4) a first indentation defined in a peripheral edge of said first panel and a second indentation defined in a peripheral edge of said second panel, said first indentation extending entirely through a thickness of said first panel and said second indentation extending entirely through a thickness of said second panel, said first indentation in said first panel being positioned adjacent to said second indentation in said second panel when said first panel and said second panel are engaged in a surface-to-surface abutting relation so as to define a cut-out portion in a peripheral edge of said card holder, said cut-out portion extending a thickness of said card holder thereby providing a gripping portion enabling said card holder to be manually grasped by inserting a portion of a finger into said cut-out portion;

(5) a separation assembly facilitating separation of said first and second panels from one another; and (6) an attachment assembly for securing said card holder to said primary backing panel.

* * * * *